US005660108A

United States Patent [19]

Pensavecchia

[11] Patent Number: 5,660,108

[45] Date of Patent: Aug. 26, 1997

[54] MODULAR DIGITAL PRINTING PRESS WITH LINKING PERFECTING ASSEMBLY

[75] Inventor: Frank G. Pensavecchia, Hudson, N.H.

[73] Assignee: Presstek, Inc., Hudson, N.H.

[21] Appl. No.: 638,226

[22] Filed: Apr. 26, 1996

[51] Int. Cl.[6] ..... B41L 17/00; B41F 5/02

[52] U.S. Cl. ..... 101/137; 101/177; 101/229

[58] Field of Search ..... 101/136, 137, 101/140, 142, 145, 177, 183, 184, 185, 217, 218, 229, 230, 246, 247

[56] References Cited

U.S. PATENT DOCUMENTS

| | | | |
|---|---|---|---|
| 2,757,610 | 8/1956 | Gegenheimer et al. | 101/230 |
| 3,198,112 | 8/1965 | Moos | 101/174 |
| 3,796,154 | 3/1974 | Weisgerber | 101/232 |
| 4,362,099 | 12/1982 | Iwamoto | 101/230 |
| 4,409,894 | 10/1983 | Fischer | 101/211 |
| 4,563,949 | 1/1986 | Rogge | 101/174 |
| 4,732,084 | 3/1988 | Wirz | 101/177 |
| 4,777,876 | 10/1988 | Ishii | 101/177 |
| 4,854,232 | 3/1989 | Oda | 101/211 |
| 4,930,414 | 6/1990 | Wirz | 101/183 |
| 4,936,211 | 6/1990 | Pensavecchia et al. | 101/136 |
| 4,967,660 | 11/1990 | Yamanari et al. | 101/229 |
| 4,976,197 | 12/1990 | Yamanari et al. | 101/137 |
| 5,042,384 | 8/1991 | DeMoore et al. | 101/483 |
| 5,406,884 | 4/1995 | Okuda et al. | 101/137 |
| 5,479,856 | 1/1996 | Wirz | 101/177 |

*Primary Examiner*—Christopher A. Bennett
*Attorney, Agent, or Firm*—Cesari and McKenna

[57] ABSTRACT

Modular printing apparatus wherein multiple central-impression presses may be linked to one another, either directly or through a perfecting assembly that reverses the facewise orientation of cut sheets. The presses each contain circuitry defining a signal and control path for the press and a plurality of electrical contacts that renders the path accessible and facilitates serial connection of the presses without disruption of the path. At least one of the presses includes a port for receiving connection to a controller, which thereby engages the signal path and, via the path, operates the presses independently or together as appropriate. The system includes a connector that is used to couple the electrical contacts of one press to those of the second press, thereby establishing a single, continuous signal and control path through both presses accessible to the controller. The system can accommodate a perfecting assembly that may be selectably engaged between the presses, and which thereby becomes a part of the system. The perfecting assembly includes circuitry defining a signal and control path for the assembly and sets of of electrical contacts capable of mating with the contacts of two presses and retaining the continuous path.

13 Claims, 3 Drawing Sheets

MODULAR DIGITAL PRINTING PRESS WITH LINKING PERFECTING ASSEMBLY

BACKGROUND OF THE INVENTION

1. Field of the Invention

The present invention relates to digital printing apparatus and methods, and more particularly to a multipress, lithographic printing system with components that can be linked together in a modular fashion.

2. Description of the Related Art

In offset lithography, a printable image is present on a printing member as a pattern of ink-accepting (oleophilic) and ink-repellent (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is clamped to an impression cylinder via grippers, which brings it into contact with the blanket cylinder.

In a wet lithographic system, the non-image areas are hydrophilic, and the necessary ink-repellency is provided by an initial application of a dampening (or "fountain") solution to the plate prior to inking. The ink-abhesive fountain solution prevents ink from adhering to the non-image areas, but does not affect the oleophilic character of the image areas.

If a press is to print in more than one color, a separate printing member corresponding to each color is required. The original image is transformed into a series of imagewise patterns, or "separations," that each reflect the contribution of the corresponding printable color. The positions of the printing members are coordinated so that the color components printed by the different members will be in register on the printed copies. Each printing member ordinarily is mounted on (or integral with) a "plate" cylinder, and the set of cylinders associated with a particular color on a press is usually referred to as a printing station.

Traditionally, the plates for offset presses have been produced photographically. However, to circumvent the cumbersome photographic development, plate-mounting and plate-registration operations entailed by this process, practitioners have developed electronic alternatives that store the imagewise pattern in digital form and impress the pattern directly onto the plate. Plate-imaging devices amenable to computer control include various forms of lasers. U.S. Pat. Nos. 5,351,617 and 5,385,092 (the entire disclosures of which are hereby incorporated by reference) disclose an ablative recording system that uses low-power laser discharges to remove, in an imagewise pattern, one or more layers of a lithographic printing blank, thereby creating a ready-to-ink printing member without the need for photographic development. In accordance with those systems, laser output is guided to the surface of the printing blank and focused onto that surface (or, desirably, onto the layer most susceptible to laser ablation, which will generally lie beneath the surface layer).

In most conventional presses, the printing stations are arranged in a straight or "in-line" configuration. Each such station typically includes an impression cylinder, a blanket cylinder, a plate cylinder and the necessary ink (and, in wet systems, dampening) assemblies. The recording material is transferred among the print stations sequentially, each station applying a different ink color to the material to produce a composite multi-color image. Another configuration, described in U.S. Pat. No. 4,936,211 (the entire disclosure of which is hereby incorporated by reference), relies on a central impression cylinder that carries a sheet of recording material past each print station, eliminating the need for mechanical transfer of the medium to each print station. With either type of press, the recording medium can be supplied to the print stations in the form of cut sheets or a continuous "web" of material.

Difficulties can arise in the manufacturing or use of in-line presses when the number of printing stations becomes large, particularly in the case of cut-sheet recording media. Passage from each printing station to the next involves a separate "handoff" of the page, requiring delicate mechanical feeding movements and, consequently, providing opportunity for slippage or malfunction. Even a small degree of slippage during one handoff may result in large overall distortions or misregistrations, because the error is propagated and amplified as the page travels through the remainder of the printing path.

Central impression designs reduce printing errors arising from paper handoff by minimizing the number of times a sheet is actually transferred. The sheet may, for example, be withdrawn from a bin and affixed to the central impression cylinder in a single operation, and stripped from the cylinder only after traversing all printing stations. In this way, misregistration errors are substantially reduced, since the opportunity for paper slippage between stations is removed. Furthermore, any errors resulting from initial paper handling are not amplified, since the orientation of the paper with respect to the printing stations remains essentially fixed.

Unfortunately, the number of printing stations that can be usefully employed in a central-impression design is limited by the circumference of the impression cylinder. It is mechanically unwieldy and economically prohibitive to employ cylinders capable of accommodating more than just a few such stations. Furthermore, central-impression designs do not lend themselves to "perfecting" operations whereby the facewise orientation of a sheet is reversed so that ink can be applied to the other side.

DESCRIPTION OF THE INVENTION

Brief Summary of the Invention

The invention expands the printing capabilities of a single central-impression press by facilitating their chaining, one to another, using a common control system. The presses can be linked directly to one another, in which case printed copy exiting the first press is delivered directly to the feeder of the second press, or by means of an intervening perfecting assembly. In the latter case, copy is reversed by the perfecting assembly before reaching the second press; preferably, the perfecting assembly is controllable by the control system to either reverse the printed copy or to pass it to the second-press feeder without reversal.

In the preferred implementation, the presses each contain circuitry defining a signal and control path for the press and a plurality of electrical contacts that render the path accessible, facilitating serial connection of the presses without disruption of the path. At least one of the presses includes a port for receiving connection to a controller, which thereby engages the signal path and, via the path, operates the presses independently or together as appropriate. The system includes one or more connectors that couple the electrical contacts of one press to those of the second press, thereby establishing a single, continuous signal and control path through both presses accessible to the controller.

The system accommodates a perfecting assembly that may be selectably engaged between the presses, and which thereby becomes a part of the system. The perfecting assembly includes circuitry defining a signal and control path for the assembly and sets of electrical contacts capable of mating with the contacts of two presses; and with the contacts so mated, the continuous signal and control path is retained. In operation, the electrical contacts of the perfecting assembly are connected to the electrical contacts of the first and second presses, and the components are mechanically engaged such that copy ejected from the first press passes through the perfecting assembly, following which it enters the feeder of the second press.

The presses are fully modular and independently controllable, so that a single configuration can accommodate multiple types of printing jobs involving different uses of the presses. For example, with two presses engaged by a perfecting assembly, some print jobs can be sent through both presses for double-sided printing, while other jobs are printed by a single side by only one of the presses without passing through the other press. In other words, with the second press selectably operating independently of the first press, the two presses can perform separate multi-color printing jobs, one of which requires the action of both presses while the other requires a single press.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
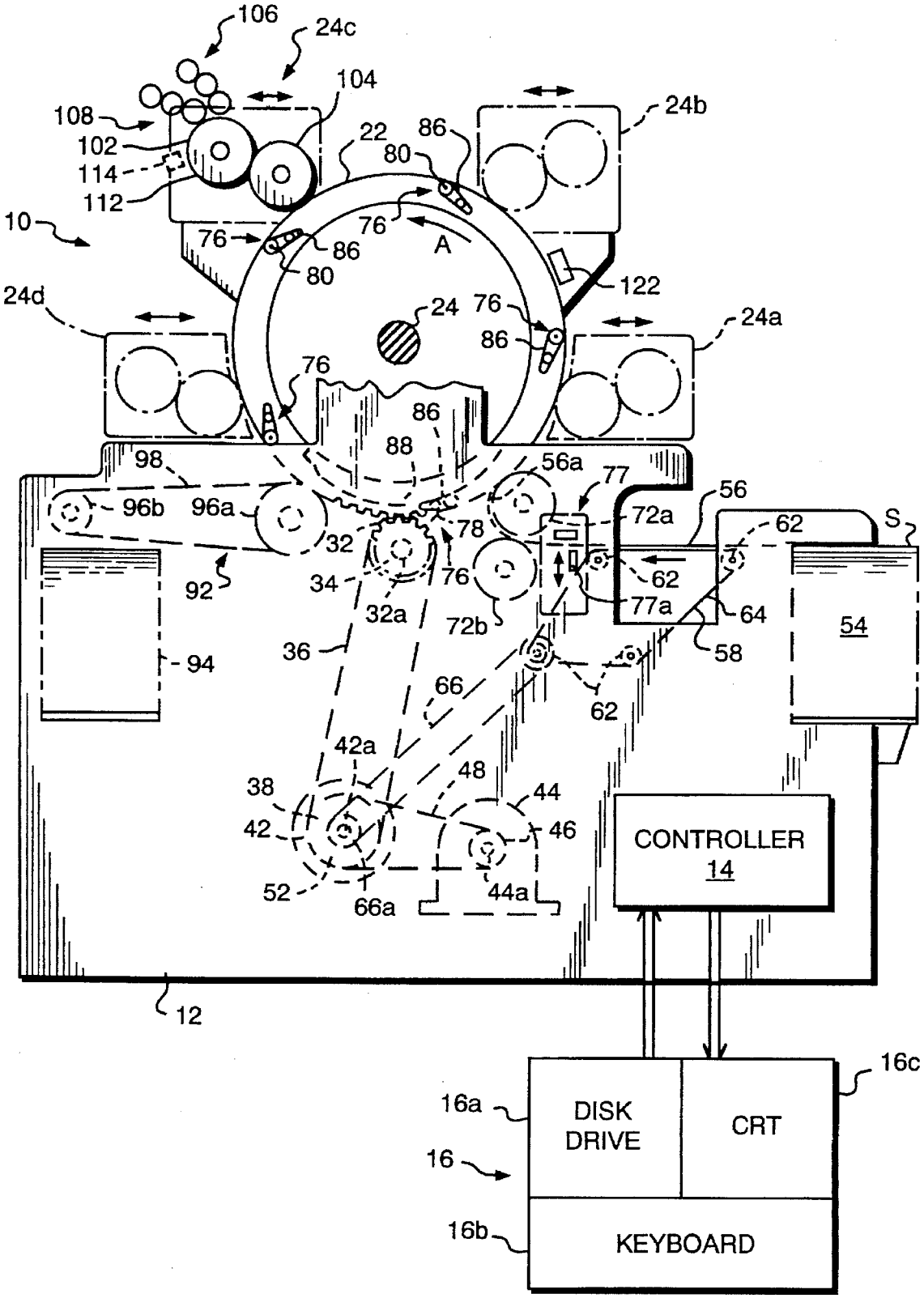
FIG. 1 (PRIOR ART)
FIG. 1 is a side elevational view of a conventional offset color press that may be modified to suit the objectives of the present invention.

Refer first to FIG. 1, which illustrates the basic components of each press in the system. The depicted press is a conventional freestanding, sheet-fed four-color offset press which, when modified as discussed below, can be utilized as part of a modular system in accordance with the invention.

The press 10 includes an upstanding machine frame 12 that normally rests on the floor. The press includes an internal controller 14 that receives input data and control signals from a separate workstation 16 connected to controller 14 by suitable cables. The press 10 responds to digital signals representing a document or image, usually in the form of a "raster" or grid-like array of pixels. Since the press prints in four colors, up to four separate series of picture signals are involved, corresponding to color separations for cyan, yellow, magenta and black. These image signals may be stored on a disk and applied to the press by way of a disk drive **16*a* associated with workstation 16. Alternatively, they may arrive from a computer, telephone line or other source. Control signals for the press are entered by an operator via a keyboard 16*b*** at the workstation. Using the keyboard, the operator may enter instructions for imaging the printing plates on press, instructions relating to press control such as ink flow adjustment, number of copies to be printed, etc.

Rotatably mounted on frame 12 is a large-diameter impression cylinder 22 having a central axle 24 journaled in opposite sides of the machine frame 12. Disposed around cylinder 22 are four substantially identical print stations **24*a*, 24*b*, 24*c* and 24*d*, which print the four colors cyan, yellow, magenta and black, respectively. Preferably the stations are supported by frame 12 as mirror-image pairs on opposite sides of cylinder 22 as shown in FIG. 1**.

Cylinder 22 is rotated by means of a drive gear 32, rotatably mounted to the machine frame via the main drive shaft, and which meshes with a gear coaxially fixed to cylinder 22. Coaxially fixed to gear 32 is a pulley 34 which is connected by a belt 36 to a pulley 38 fixed to the output shaft **42*a* of a transmission 42 mounted at the bottom of frame 12. The transmission 42 is driven by an adjacent electric motor 44 having an output shaft 44*a* carrying a pulley 46 connected by a V-belt 48 to a pulley 52 on the input shaft (not shown) of transmission 42. In the illustrated press, cylinder 22 is rotated counterclockwise as shown by arrow A in FIG. 1**.

Individual paper sheets S are fed to the impression cylinder 22 from a tray 54 at the righthand side of press 10 as viewed in FIG. 1. At appropriate points in the rotation of cylinder 22, while the cylinder continues to rotate, the topmost paper sheet S in tray 54 is picked from the stack and carried along a guide 56 leading toward cylinder 22 by a conventional paper feeding mechanism or feeder shown generally at 58. The illustrated paper feeder 58 basically comprises an array of pulleys 62 mounted to the machine frame around which are trained one or more belts 64, the lowermost pulley 62 being rotated by a drive belt 66 which extends down to a pulley **66*a* on the output shaft 42*a* of transmission 42. The paper feeder 58, which may include picker fingers or suction means on each belt 64, picks up and carries each paper sheet S from tray 54 to the impression cylinder 22**.

The paper feeder delivers the paper to a registration station shown generally at 77. At this station, the leading edge of the paper is stopped by vertically movable fingers **77*a*** that register it to be parallel to the axis of the impression cylinder. Once this is done, the paper is moved toward a side guide (not shown), by any conventional means, to assure that it has been squared up and is in the correct axial position relative to the impression cylinder.

Before each sheet S reaches impression cylinder 22, its leading end is guided by an upwardly curved lefthand end segment **56*a* of guide 56 through the nip of one or more pairs of upper and lower accelerating rollers or wheels 72*a* and 72*b*. These rollers are rotated by conventional means (not shown) so that their surface speeds exceed that of impression cylinder 22. Thus, just before it reaches the cylinder, the leading end segment of each sheet is accelerated upward directly toward the surface of cylinder 22**.

Cylinder 22 is provided with a circumferential array of paper clamping or gripping assemblies shown generally at 76. Each assembly 76 comprises an elongated gripper 78 which is rotatably mounted by pivots 80 at its opposite ends in a lengthwise slot 82 in cylinder 22. Each gripper is notched at 78*a* to provide clearance for wheels 72*a*. The pivot 80 at the lefthand end of gripper 78 extends through the adjacent end wall of slot 82 and is rotatably fixed to one end of a cam-following lever 86 positioned adjacent to the lefthand end of cylinder 22. The opposite end of lever 86 is thus free to swing radially in and out. When the free end of each lever 86 is in its outer position as shown at the bottom of cylinder 22 in FIG. 1, the associated gripper 78 is in its open position as shown, so that is able to receive or intercept the leading end of a paper sheet S. On the other hand, when the free end of each lever 86 in its radially inner position as shown at the top of cylinder 22 in FIG. 1, the associated gripper 78 is in its closed position wherein it lies flush against the surface of the cylinder.

Each gripper 78 is spring-biased toward its closed position and it is opened only when the associated lever 86 encounters an arcuate cam 88 fixedly mounted to frame 12 adjacent to the lefthand end of cylinder 22. The cam is located adjacent to a lower angular sector of the cylinder, (i.e. between 5 and 7 o'clock), so that when the cylinder is rotated to position one of the levers 86 opposite the cam, the associated gripper 78 is moved to its open position. Thus, before it is advanced opposite the paper-guide end segment 56*a*, that gripper is ready to receive the leading end of the sheet S then being advanced by the paper feeder 58 to cylinder 22. Immediately thereafter, the lever 86 leaves the camming surface of cam 88, allowing gripper 78 to snap to its closed position to thereby grip that sheet, so that the sheet becomes wrapped about the cylinder as that continues to rotate.

The cylinder 22 in press 10 may have four, five or six such gripping assemblies 76 distributed at equal angles around the cylinder. Each time a paper sheet S is fed to the cylinder and is gripped by a gripper 78, that entire sheet is advanced past all four print stations 24*a* to 24*d* before being released to a printed-copy delivery station shown generally at 92, at the opposite side of the press below print station 24*d*. Conveyor 92 comprises a conventional mechanism for transporting paper sheet S from the surface of cylinder 22 to a receptacle 94 for printed copies. The conveyor is illustrated here as simply a pair of rollers 96*a*, 96*b* carrying endless belts 98 that may support pickers or suction means (not shown) for pulling the trailing end of a sheet S from the surface of cylinder 22 after that sheet has been released by the lowermost gripper 78 (opened by engagement of its lever 86 with cam 88, as shown at the bottom of cylinder 22).

Thus, press 10 is able to print on four successive paper sheets S simultaneously at the four print stations 24*a* to 24*d*, while a fifth fully printed sheet is being picked from the cylinder by the delivery station 92, and a fresh paper sheet is about to be loaded onto the cylinder by paper feeder 58. The press may include other known mechanisms such as paper guides, rollers, pickers, suction mechanisms, etc. to facilitate loading and offloading of the paper sheets. Actually, each sheet S may comprise of a number of document pages or image areas, the actual number depending upon the length of the press cylinders and the size of the image.

As mentioned previously, the print stations 24*a* to 24*d* are substantially identical. Therefore, only one of them, e.g., print station 24*c*, will be described in detail. Station 24*c* comprises a plate cylinder 102 which makes surface contact with a blanket cylinder 104 of the same diameter, and that, in turn, is in surface contact with impression cylinder 22. More or less conventional ink and water systems 106 and 108 apply ink and water, respectively, to the surface of plate cylinder 102. Preferably, the ink fountain of the former system includes means for automatically controlling ink flow so that the amount and distribution of ink applied to the plate cylinder can be regulated by signals from press controller 14. One suitable fountain of this type is disclosed in U.S. Pat. No. 4,058,058. Preferably also, the print station 24*c* is slidably or pivotably mounted on machine frame 12 as shown by the double-headed arrows in FIG. 1 so that its blanket cylinder 104 can be moved into or out of contact with impression cylinder 22.

While the present invention can be practiced with presses having conventional print stations, the print stations 24*a* to 24*d* of press 10 preferably facilitate imaging of a lithographic plate or printing member 112 by a scanning write head 114 when the plate is mounted on the plate cylinder 102. Most preferably, write head 114 responds to picture signals from controller 14, delivering the outputs of a series of lasers to the surface of plate 112 to thereby impose the image pattern thereon. A representative plate construction may include a topmost layer, an ablation layer and a bottommost substrate. The topmost layer is chosen for its affinity for (or repulsion of) ink or an ink-abhesive fluid. The substrate is characterized by an affinity for (or repulsion of) ink or an ink-abhesive fluid opposite to that of the first layer. Exposure of the plate to a laser pulse ablates the absorbing second layer, weakening the topmost layer as well. As a result of ablation of the second layer, the weakened surface layer is no longer anchored to an underlying layer, and is easily removed. The disrupted topmost layer (and any debris remaining from destruction of the absorptive second layer) is removed in a post-imaging cleaning step. This creates an image spot having an affinity for the ink or ink-abhesive fluid different from that of the unexposed first layer. Other suitable printing-member constructions appear in the '092 patent as well as U.S. Pat. Nos. 5,339,737 and 5,379,698.

Alternatively, the imaging means of write head 114 may be another type of device such as a spark-discharge stylus, electrode, etc. capable of imagewise exposing or otherwise altering the surface of plate 112 so as to impress an image on the plate in response to picture signals applied to it by press controller 14.

The plate 112 carrying the image of the original document or picture to be copied is inked and dampened in the usual way by systems 106 and 108. That inked image is transferred to the blanket cylinder 104, and from there to the paper sheets S wrapped around the impression cylinder 22. For "wet" lithographic plates 112, both water and ink from the systems 108 and 106, are coated onto the surface of the plates. "Dry" plates 112 require no water from the water system 108, and accordingly, that system may be disabled, deactivated or omitted from the press entirely. In both wet and dry systems, the ultimate objective is to transfer an inked image from the plate cylinder 102 via the blanket cylinder 104 to the paper or (other recording medium) on impression cylinder 22.

As described previously, impression cylinder 22 is of a size to allow the four print stations 24*a* to 24*d* to print four different color images on four separate paper sheets S simultaneously. To accomplish this effectively and efficiently, it is essential that the relative positions of the images being printed on sheets S by the four print stations be precisely known and controlled. Otherwise, the four different color images printed on each sheet S will be out of register with respect to each other.

The fact that all of the sheets S are mounted on a single large impression cylinder while being printed on by all four print stations 24*a* to 24*d* contributes greatly to the ability of press 10 to print the different color components of each impression in register. This is because, as noted above, each paper sheet S is gripped at the surface of plate cylinder 22 only once. Therefore, the position of that sheet is fixed while the sheet is rotated into contact with the blanket cylinders 104 of all four print stations. Only then is the sheet released to the delivery station on 92. This is in sharp contrast to the situation in in-line presses which grip and release each sheet at separate impression cylinders of the four print stations in the series, resulting in four separate handoffs. Obviously, such multiple gripping or handing off of each sheet can cause variations in the position of the sheet from station to station. These positional variations tend to be more or less random, and are therefore difficult to compensate for either mechanically or electronically.

The use of a large impression cylinder 22 in press 10 produces an ancillary advantage in that the position or phase angle of cylinder 22 at any given time can be detected or monitored with a high degree of accuracy. In the illustrated press, this is accomplished by means of a magnetic detector 122 positioned on machine frame 12 opposite a large-diameter steel strap on a band extending around one end of cylinder 22. The band has etched lines or marks around its circumference. Detector 122 detects these marks and develops position signals which are applied to controller 14. The controller is thus able to monitor the angular position of impression cylinder 22 and, on the basis of that information, to control the timing of the various press functions. Since the blanket cylinders 104 and the plate cylinders 102 are all geared directly to the impression cylinder gear 28, the relative positions of those cylinders are also known to a high degree of accuracy.

The operator can also regulate ink flow at each print station using keyboard **16*b* in the event that is deemed advisable from examining the printed copies in the course of a printing run. Further, the controller 14 can be programmed to automatically control the adjusting screws along each ink fountain doctor blade to set the screws in accordance with the amount of ink required across the image based on a count of the number of dots of each color to be printed in the band controlled by each adjusting screw. Optionally, by addition of a densitometer, it is possible to achieve a fully automatic closed loop color adjusting system. The initial settings of the doctor blades may be based on a dot count done by the controller/computer as previously described. Using an "on the fly" color densitometer, the various colors (within the color bar) can be scanned, and the results fed back to controller 14**. The controller compares the densitometer readings to the original dot-count analysis and makes new doctor blade adjustments, if needed. These steps can be repeated as many times as required. Once the process is completed, the data for each print station can be stored as the pedigree of that station. This color pedigree or fingerprint can then be used for the set up of the next printing job. Using this approach, each successive job should come closer to final settings from the outset.

The controller may also be programmed to automatically control the other usual press operations such as start up, shut down and clean-up.

Figure 2:
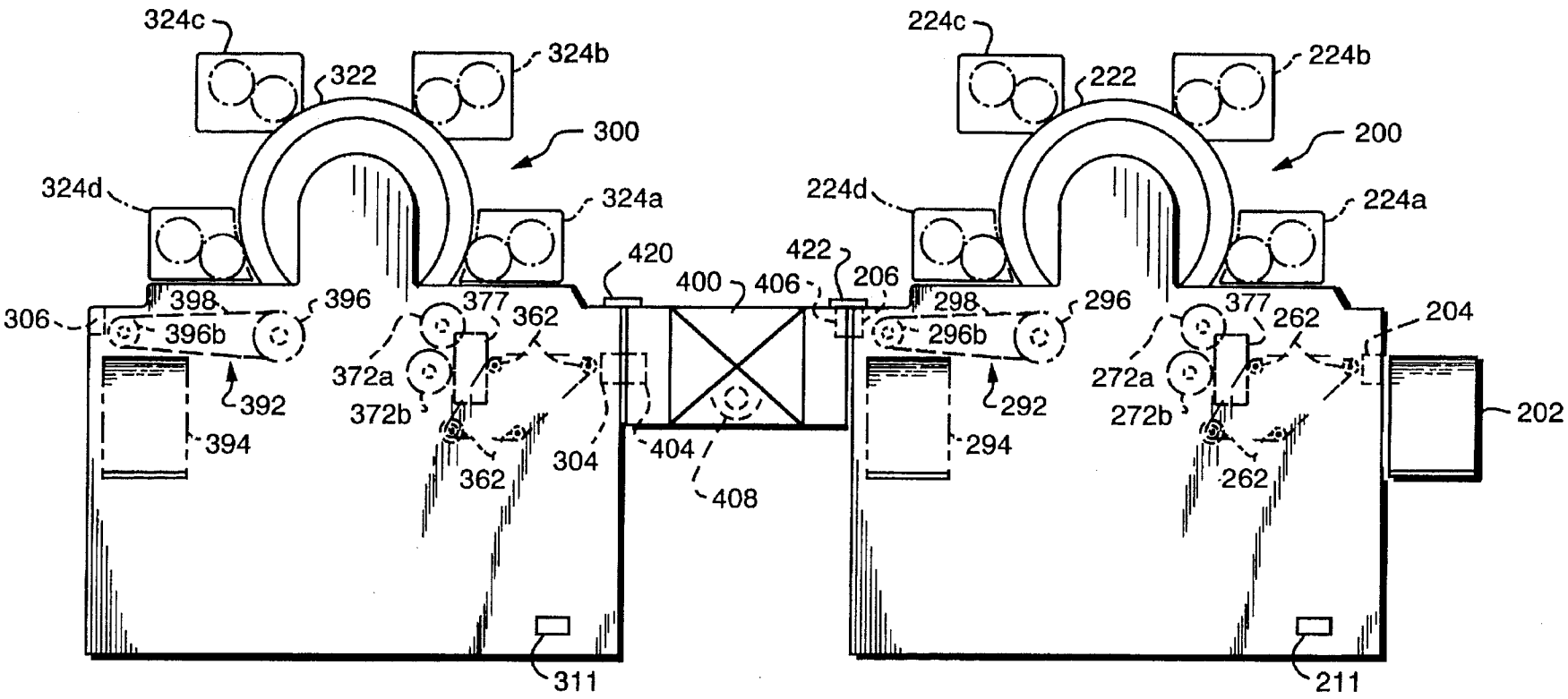
FIG. 2 is a side elevational view of a system according to the invention that includes two offset presses and a perfecting assembly.

Refer now to FIG. 2, which illustrates the manner in which the basic press design shown in FIG. 1 can be modified to suit the objectives of the present invention. The illustrated embodiment comprises first and second multistation presses 200, 300, selectably linked together by a perfecting assembly 400. The presses themselves contain operative components analogous to those discussed above in connection with press 10. In particular, each impression cylinder 222, 322 is surrounded by a series of print stations **224*a*, 224*b*, 224*c*, 224*d* and 324*a*, 324*b*, 324*c*, 324*d*, respectively. Each press also contains components that collectively define a continuous paper path through press 200, perfecting assembly 400 and through press 300, optionally ending with press 200. More specifically, paper stock stored in a removable bin 202 passes through a passage 204 in press 200 to a feeding mechanism. In the illustrated embodiment, that mechanism includes an array of pulleys 262 that operate an endless belt 264 to carry paper sheets through a registration station 277**. It should be stressed, however, that other feeder mechanisms of conventional design can be substituted.

After emerging from station 277, the registered sheets pass through the nip of a set of accelerating rollers **272*a*, 272*b* and are clamped to impression cylinder 222 as described above. After encountering the print stations 224*a*, 224*b*, 224*c*, 224*d* and receiving ink thereat, the sheets are stripped from cylinder 222 and advanced either to perfecting assembly 400 by means of a delivery station 292, or to a collection bin 294. The path that any particular sheet or run of sheets follows is determined by controller 14, which can be programmed to direct different jobs through different components of the system. As discussed above, delivery station 292 comprises a conveyor 298 carried by rollers 296*a*, 296*b*. The sheets pass through a set of complementary openings or ports 206, 406 and, after facewise reversal, are ejected from perfecting assembly 400 through an exit port 404 and enter press 300 through a congruent entry port 304. Once in press 300, the sheets traverse an identical paper path as shown, with equivalent components denoted by reference numerals differing only in their first digits (e.g., conveyor 398 of press 300 corresponding to conveyor 298 of press 200). The sheets accumulate in a collection bin 394**.

The details of construction of perfecting assembly 400 are not critical; suitable designs are well-known in the art. Generally, a reversing cylinder (having suitable paper grippers) rotates against the direction of linear sheet movement, picking up the leading edge of the sheet and rotating the sheet into a reversed orientation before its trailing end is gripped by a second cylinder that dispenses the sheet back into the paper path. See, e.g., U.S. Pat. Nos. 2,757,610; 3,796,154; and 4,362,099. Preferably, perfecting assembly 400 can be controlled to selectably effect reversal or pass the sheet to press 300 without reversal. The registration of two four-color printing jobs on opposite paper sides is not as critical as between successively applied inkings on the same side. Perfecting assembly 400 can include an ink-curing station 408 (comprising, for example, a UV light source) for drying the ink applied by press 200 before the inked side of the sheet is drawn against the impression cylinder 322 of press 300.

The foregoing configuration facilitates true modularity, since the function of each press in the overall system is determined merely by the manner in which it is connected and operated by controller 14 rather than by its intrinsic construction; the presses themselves are identical. Controller 14 and workstation 16, instead of being integral or fixedly associated with a particular press, is ordinarily connected to whichever of the presses is the first in the series by means of a jack 211, 311. Electrical connection between the controller, each press and the perfecting assembly is maintained by an appropriate matrix of contacts, leads and cables that traverse the system. Thus, in the illustrated embodiment, perfecting assembly 400 is removably secured to presses 200, 300 by a pair of couplings 420, 422. These couplings may include electrical bridge contacts that mate power, control and data-transfer pins on the presses 200, 300 with complementary contacts on perfecting assembly 400, thereby allowing full control of all system components to be retained by the controller connected to jack 211. The signals operating the various press components and traversing the pathways established by the contacts, leads and couplings originate with the controller 14.

Figure 3:
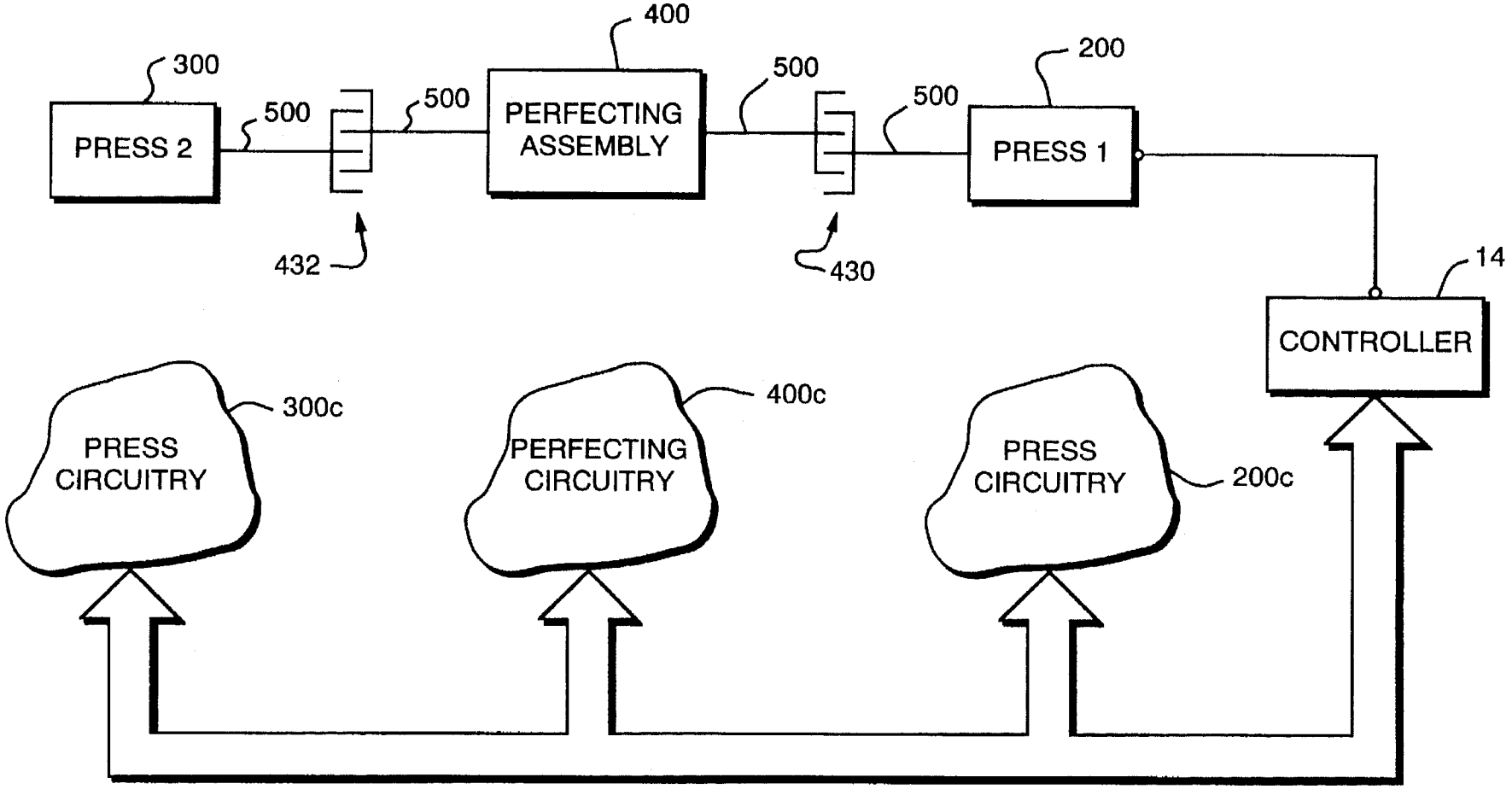
FIG. 3 schematically depicts connections among the components of a system embodying the invention and their operation.

This arrangement is depicted schematically in FIG. 3. Electrical connection between press 200 and perfecting assembly 400 is established by a system of complementary contacts 430, which are mated by coupling 422 (see FIG. 2). Similarly, connection between perfecting assembly 400 and press 300 is established by a second system of complementary contacts 432, which are mated by coupling 420. This establishes a continuous signal pathway 500 through the various components of the system. In this way, controller 14, once associated with one of the components (e.g., press 200), can supply power (or cause power to be supplied) to and exchange data and control signals with the electrical circuitry $\mathbf{200}_c$, $\mathbf{300}_c$, $\mathbf{400}_c$ associated with any of presses 200, 300 and perfecting assembly 400, respectively. For example, press 300 might be connected directly to press 200 without an intervening perfecting assembly. This condition is detected directly by controller 14, which sends an initial series of signals at setup to determine the components of the system; controller 14 then opens power, control and data pathways relevant only to those system components it determines to be present. It should also be understood that the overall system can include any desired number and arrangement of presses and perfecting assemblies.

Via controller 14 and workstation 16, the operator can influence or direct the function of any of the system components. For example, the operator can alter the ink flow at any print station of any press in the system, or control the various plate-imaging assemblies, or determine the paper path for a particular job, or selectively disable one of the system components without interrupting the paper path. These capabilities provide flexibility in situations calling for consecutive printing jobs, some of which require paper reversal while others require same-side impression by more printing stations than one press can support, and still others requiring printing at only one press. For example, the first press in a series is ordinarily a four-station press configured to apply a four-color gamut. The second press may be an identical four-color press, facilitating equivalent, two-sided color printing, in which case controller 14 selectively causes perfecting assembly 400 to effect facewise reversal or to pass the sheet without reversal. Alternatively, the second press can be configured to apply custom colors (e.g., metallic or pearlescent colors, or special hues that cannot be recreated by the four-color gamut of the first press), specialty inks, spot lacquer or varnish and/or low-gloss varnish. For example, one station of the second press might apply low-gloss varnish to some print areas while another station applies high-gloss varnish to different areas in order to achieve custom-design effects.

It will therefore be seen that I have developed a reliable and highly extensible modular printing system that requires minimal handoff operations. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. Modular apparatus for printing on a printing substrate, the apparatus comprising:

a. first and second printing presses each comprising:

1) a rotatable impression cylinder;

2) a plurality of print stations distributed circumferentially around the cylinder, each print station comprising means for supporting a lithographic printing member; means for forming, on the surface of a lithographic printing member carried on the support means, a pattern corresponding to an image; means for applying a printing liquid to the lithographic printing member in accordance with the pattern; and means for transferring the printing liquid to the substrate on the impression cylinder;

3) means for receiving the substrate;

4) means for releasably gripping the substrate flush against the impression cylinder in a facewise orientation;

5) means for stripping the substrate from the impression cylinder after it has been advanced past all of the print stations; and 6) handoff means for controllably ejecting the substrate from the press;

b. perfecting means, engageable to the first-press handoff means, comprising:

1) means for reversing the facewise orientation of the printing substrate; and 2) handoff means for controllably ejecting the substrate;

wherein c. the second-press receiving means is engaged to and receives the substrate from the handoff means associated with the first press or with the perfecting means.

2. The apparatus of claim 1 wherein:

a. the substrate is in sheet form;

b. the gripping means is movable between gripping and releasing positions;

c. the first-press receiving means is configured to feed sheets one-by-one to the first-press impression cylinder for gripping by the gripping means in the releasing position;

d. the stripping means strips each sheet from the impression cylinder when the gripping means is in the releasing position; and e. the gripping means is maintained in the gripping position as the substrate is advanced past the print stations.

3. The apparatus of claim 1 wherein the presses and the perfecting means are configured for two-sided printing, the substrate having obverse and reverse faces, wherein:

a. the reverse face of the substrate is held against the first-press impression cylinder;

b. the perfecting means is engaged to and receives the substrate from the first-press handoff means;

c. the second-press receiving means is engaged to and receives the facewise-reversed substrate from the perfecting means; and d. the obverse face of the substrate is held against the second-press impression cylinder.

4. The apparatus of claim 3 wherein the impression cylinder carries a number of gripping means spaced around its circumference, the number being at least equal to the number of print stations.

5. The apparatus of claim 1 wherein the lithographic printing member comprises a printing surface including a first layer, an absorptive layer and a third layer, the absorptive layer being disposed between the first and third layers and characterized by ablative absorption of imaging radiation, the first and third layers differing in affinity for a printing liquid selected from ink and an abhesive fluid for ink, and further wherein the image-forming means of each print station comprises:

a. at least one laser source that produces an imaging output;

b. means for guiding the output of the at least one laser to focus on the printing member;

c. means for causing relative movement between the guiding means and support means to effect a scan of the printing surface by the laser output; and d. means for selectably actuating, in a pattern representing an image, the laser source so as to ablate the absorptive layer, thereby removing or facilitating removal of the first layer and directly producing on the member an array of image features.

6. The apparatus of claim 1 further comprising, in each printing press, means for registering the substrate prior to its being gripped against the impression cylinder.

7. The apparatus of claim 3 further comprising ink-drying means for drying ink before the obverse face of the substrate is held against the second-press impression cylinder.

8. Modular apparatus for printing on a printing substrate, the apparatus comprising:

a. first and second printing presses each comprising:

1) a rotatable impression cylinder;

2) a plurality of print stations distributed circumferentially around the cylinder, each print station comprising means for supporting a lithographic printing member; means for forming, on the surface of a lithographic printing member carried on the support means, a pattern corresponding to an image; means for applying a printing liquid to the lithographic printing member in accordance with the pattern; and means for transferring the printing liquid to the substrate on the impression cylinder;

3) means for receiving the substrate;

4) means for releasably gripping the substrate flush against the impression cylinder in a facewise orientation;

5) means for stripping the substrate from the impression cylinder after it has been advanced past all of the print stations; and 6) handoff means for controllably ejecting the substrate from the press;

7) a plurality of electrical contacts;

8) means defining a signal and control path for the press and accessible via the electrical contacts;

b. means for selectably connecting the electrical contacts of the first press with the electrical contacts of the second press, thereby establishing a continuous signal and control path through both presses;

c. a controller for controlling the operation of each press via the path;

d. means associated with at least one of the presses for facilitating operative connection to the controller, the connection, when established, connecting the4 controller to the signal and control path, wherein e. with the electrical contacts of the first press connected to the electrical contacts of the second press, the second-press receiving means is engageable to, so as to receive the substrate from, the handoff means associated with the first press.

9. The apparatus of claim 8 further comprising selectably engageable perfecting means comprising:

a. means for reversing the facewise orientation of the printing substrate;

b. means for engaging the first-press handoff means;

c. handoff means for controllably ejecting the reversed substrate;

d. a plurality of electrical contacts;

e. means defining a signal and control path for the perfecting means and accessible via the electrical contacts;

f. means for selectably connecting the electrical contacts of the perfecting means with the electrical contacts and the first and second presses, thereby establishing a continuous signal and control path through both presses and the perfecting means;

wherein g. with the electrical contacts of the perfecting means connected to the electrical contacts of the first and second presses, the second-press receiving means is engageable to, so as to receive the substrate from, the handoff means associated with the perfecting means.

10. The apparatus of claim 9 wherein the perfecting means is selectably actuable, via the controller, to reverse the substrate or to pass the substrate to the second-press receiving means without reversal.

11. The apparatus of claim 9 wherein the first and second presses and the perfecting means are separately addressable by the controller.

12. The apparatus of claim 9 wherein the presses are selectably actuable, via the controller, so as to facilitate printing of a substrate by one or both presses.

13. The apparatus of claim 8 wherein the lithographic printing member comprises a printing surface including a first layer, an absorptive layer and a third layer, the absorptive layer being disposed between the first and third layers and characterized by ablative absorption of imaging radiation, the first and third layers differing in affinity for a printing liquid selected from ink and an abhesive fluid for ink, and further wherein the image-forming means of each print station comprises:

a. at least one laser source that produces an imaging output;

b. means for guiding the output of the at least one laser to focus on the printing member;

c. means for causing relative movement between the guiding means and support means to effect a scan of the printing surface by the laser output; and d. means for selectably actuating, in a pattern representing an image, the laser source so as to ablate the absorptive layer, thereby removing or facilitating removal of the first layer and directly producing on the member an array of image features.

* * * * *